United States Patent [19]

Vainer

[11] 4,153,852

[45] May 8, 1979

[54] COMPACT PIEZOELECTRIC LIGHTER FOR GAS FIXTURES

[76] Inventor: Ernesto A. Vainer, Paraguay 1102, Buenos Aires, Argentina

[21] Appl. No.: 762,731

[22] Filed: Jan. 26, 1977

[30] Foreign Application Priority Data

Apr. 3, 1976 [AR] Argentina ..... 262.062

[51] Int. Cl.[2] ..... H01L 17/10

[52] U.S. Cl. ..... 310/339; 361/260

[58] Field of Search ..... 310/339; 361/260; 431/255

[56] References Cited

U.S. PATENT DOCUMENTS

| | | | |
|---|---|---|---|
| 3,307,053 | 2/1967 | Furth | 310/339 |
| 3,457,461 | 7/1969 | Steinke et al. | 310/339 X |
| 3,826,952 | 7/1974 | Iwasaki et al. | 310/339 X |

FOREIGN PATENT DOCUMENTS

| | | | |
|---|---|---|---|
| 2522497 | 11/1975 | Fed. Rep. of Germany | 310/339 |
| 1385155 | 2/1975 | United Kingdom | 310/339 |

*Primary Examiner*—Mark O. Budd

*Attorney, Agent, or Firm*—Allegretti, Newitt, Witcoff & McAndrews

[57] ABSTRACT

A piezoelectric lighter for gas fixtures with fewer separate parts and a simplified construction. A mechanism for producing excitation of the piezoelectric material in which the element yielding to release the hammer for its impact run is eliminated, an assembly casing which forms the insulating housing for the piezoelectric material, an ignition terminal having a nozzle that conforms to one of the electrodes and a projecting rod of the piezoelectric supporting butt defining the second electrode, and a single piece, formed impact hammer.

4 Claims, 5 Drawing Figures

COMPACT PIEZOELECTRIC LIGHTER FOR GAS FIXTURES

BACKGROUND OF THE INVENTION

The present invention refers to a compact piezoelectric lighter for gas fixtures and particularly to a novel combination of means that lead to the obtainment of a new industrial product having substantial advantages over those already known.

As is already known, the piezoelectric lighter or "spark arrester" is based on the use of a so-called "ignition capsule" that consists of a closed capsule, generally ceramic, wherein the piezoelectric material is housed between the support and impact butts that define the electric poles of the capsule. These poles are connected to facing electrodes by means of the corresponding conductors. A "spark" is produced between the facing electrodes in response to the excitation of the above-mentioned piezoelectric material housed in the capsule.

The mechanisms used to produce the excitation basically require the following elements: a button or pulsator that constitutes the operation means displaceably joined to a body that houses the ignition unit; a return spring for said pulsator; a hammer load spring, the latter constituted by a machined piece that constitutes the impact means; and a complementary means or element, also elastic, that is capable of yielding to release the hammer for its impact run and to retain same in position in the return run. In the position described the load spring is compressible due to the displacement of the pulsator.

The lighters require the combination of a great number of component parts, which, in turn, limits both the potential for reducing the size of the lighters and the simplicity of the lighters. These same limitations require numerous machining and assembly operations that greatly increase the production costs of piezoelectric lighters.

BRIEF SUMMARY OF THE INVENTION

The invention, based on a revolutionary concept of the assembly, has reduced the component parts of a piezoelectric lighter to the minimum, making it so simple that the production of said parts as well as the assembly of same permits a remarkable decrease in the number of operations and, therefore, of the manufacturing costs. In addition, the invention results in a device capable of offering a long useful life with practically no maintenance and/or repair expense.

One of the principal advantages of the invention is that, although as in the usual cases it has a pulsator return spring and a load spring for the displacement of the impact hammer, the third elastic component of the mechanism has been eliminated in that it forms an integral part of the fixture of the pulsator. In other words, the retention and release means of the hammer form an integral part molded with the casing of the pulsator or of its operation button, instead of being formed by an additional piece of the device.

Another important advantage is the elimination of the need for having an independent ignition capsule and the connection cables to same, as the end portion of the assembly casing forms the insulation housing for the piezoelectric material as well as the respective support and impact butts that define its poles.

Another advantage is offered by the concept of an ignition terminal in which the electric conductors have been eliminated, the terminal having a nozzle that conforms to one of the electrodes and a projecting rod of the piezoeletric support butt being integral with said butt or directly connected to same, said terminal also defines the second electrode housed in the open portion of the nozzle.

Another advantage of the assembly may be observed from the concept of the impact hammer that instead of the usual cylindrical member, is now formed by a piece of an adequate material, preferably stamped, that is conveniently guided in the operation pulsator.

The other advantages and characteristics of the invention may be observed in the description of its specification. For a better understanding and comprehension, this specification has several figures attached with the drawings of a preferred embodiment of the compact piezoelectric lighter of this invention.

BRIEF DESCRIPTION OF THE DRAWINGS

FIG. 5 is a side cross-sectional view of the assembled lighter showing how pressing the operation pulsator to the final stage creates impact between the impact between the impact hammer, m, and the terminal of the piezoelectric material, 5, with the deformed elastic lugs joined by the retention transversal rod of the hammer and said rod in the back portion of the longitudinal guide of the hammer.

DETAILED DESCRIPTION

In the different figures the similar or equivalent parts have been marked with similar reference marks.

As may be observed from the figures of the invention, the compact piezoelectric lighter for gas fixtures includes a hollow body or housing a in which a pulsator P is slidably connected. The pulsator p runs through the open back end of said body a. The body a is preferably integrally molded with its end portion 1 opposite the insertion of the pulsator p defining an outer groove adapted to receive a nozzle b for the conductor material.

Figure 3:
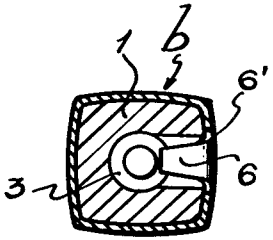
FIG. 3 is a cross section view of the lighter of FIG. 2 taken along the line III-III thereof showing the lug inserted in the conduit that forms an integral part of the conducting nozzle in contact with the impact butt.

The end portion 1 forms a housing that encloses a piezoelectric material 2 between an impact butt 3 and a support butt 4, the latter projecting outside the end portion 1 in a terminal 5 that forms an electrode, as the support butt 4, in contact with the piezoelectric 2, defines one pole of same. The opposite pole is defined against the inside part of the impact butt 3 and is in contact by means of a folded lug 6 with the nozzle b of which the latter forms part. The lug 6 passes through an opening $6^1$ of the end portion 1 to make contact with the impact butt 3 as shown in FIG. 3. The spark is produced between terminal 5 and the wall of the open end of nozzle b when the piezoelectric material 2 is excited. In this manner, the body a defines the container of the piezoelectric material 2 that does not require, as is usual, an insulated capsule independent from the housing.

In front of the impact butt 3 the walls of the body a have grooves 7 on both sides substantially with a "U" shape with their ends directed toward the pulsator p, said grooves 7 forming lugs 8, which are elastically deformed that are joined together by a transversal bolt or rod 9 mounted between their ends. The transversal rod 9 runs through a guide groove 10 formed on an impact hammer m. At the end portion directed toward the impact terminal the guide groove 10 has a bend 11 that defines the housing of said rod 9 in the retention position of the hammer m.

From the top edge of hammer m is at least one projection 12 (in the example illustrated in the figures a pair of projections 12 are shown in the top and bottom edges). In the assembly position hammer m is displaceably housed in the pulsator p and is guided in a respective longitudinal groove 13 of pulsator p. In the figures showing the embodiment, the pulsator p has a set of opposed grooves 13 to guide the projections 12 projecting from the hammer m, to insure an improved relative displacement between the parts.

The displaceable portion of the pulsator p within the body a forms longitudinal openings 14 on both sides of the upper edges of which respectively have inclined lengths 15 that rise from the back to the front. In the assembly, the longitudinal openings 14 correspond with the position of groove 10 of hammer m and are crossed by the retention rod 9. A spring 16 is slideably joined between the closed end terminal of the pulsator p and the hammer m. When loaded, the spring 16 constitutes a sharp thrust means for the impact. A return spring 17 of said pulsator p is housed between the open end edge of pulsator p and the bottom of the body cavity a in which the impact terminal 3 is projected.

As an accessory and for greater comfort, the body a forms a molded outer portion 18 that is shaped as a grip butt, making the handling of the lighter more comfortable.

Figure 1:
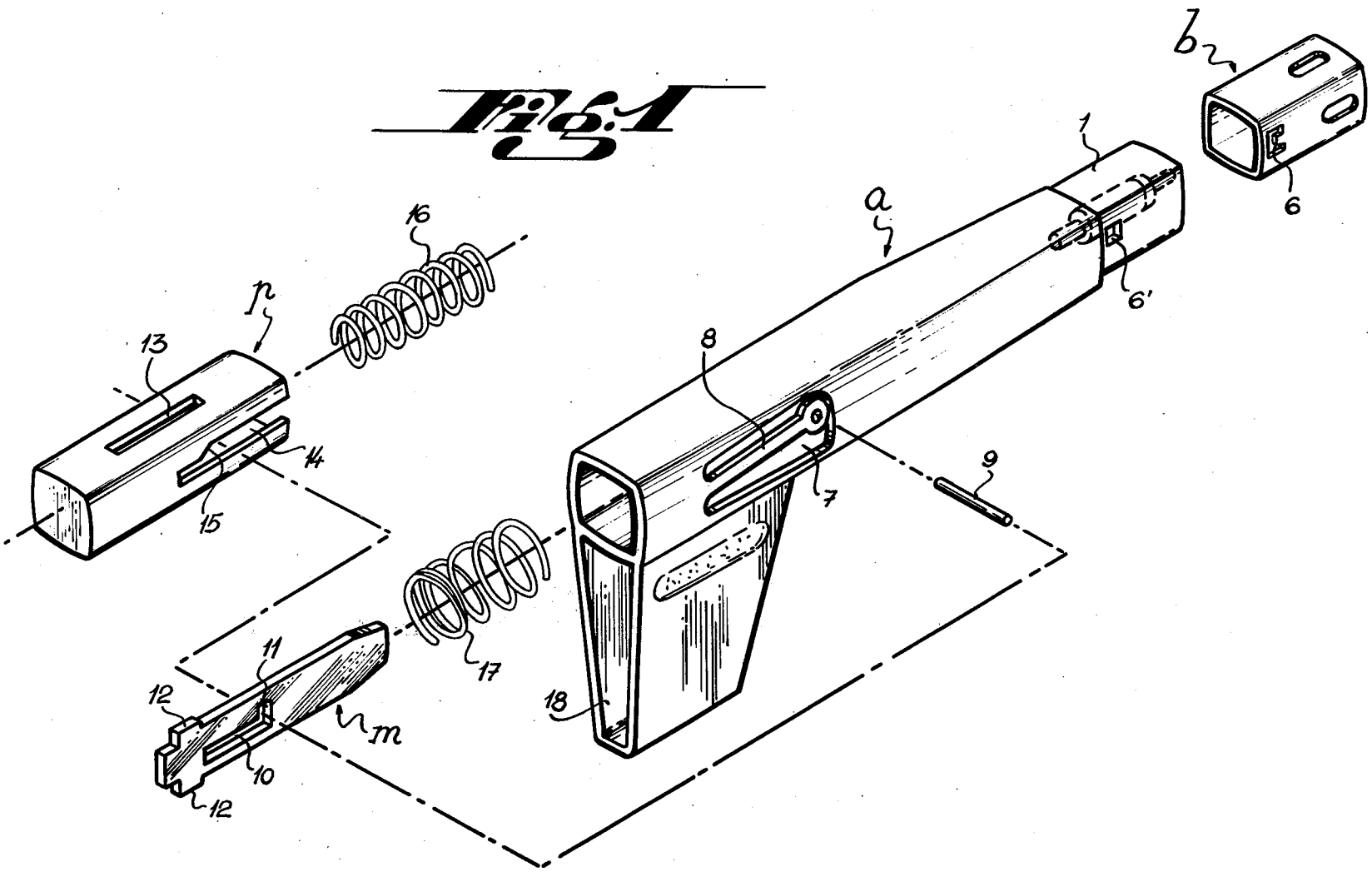
FIG. 1 is an exploded perspective view of the preferred embodiment of the compact piezoelectric lighter of this invention in which it may be observed that the component parts of same are reduced to the minimum. In this figure the piezoelectric member is marked with dashes with the butts housed in the end portion of the assembly casing.
Figure 2:
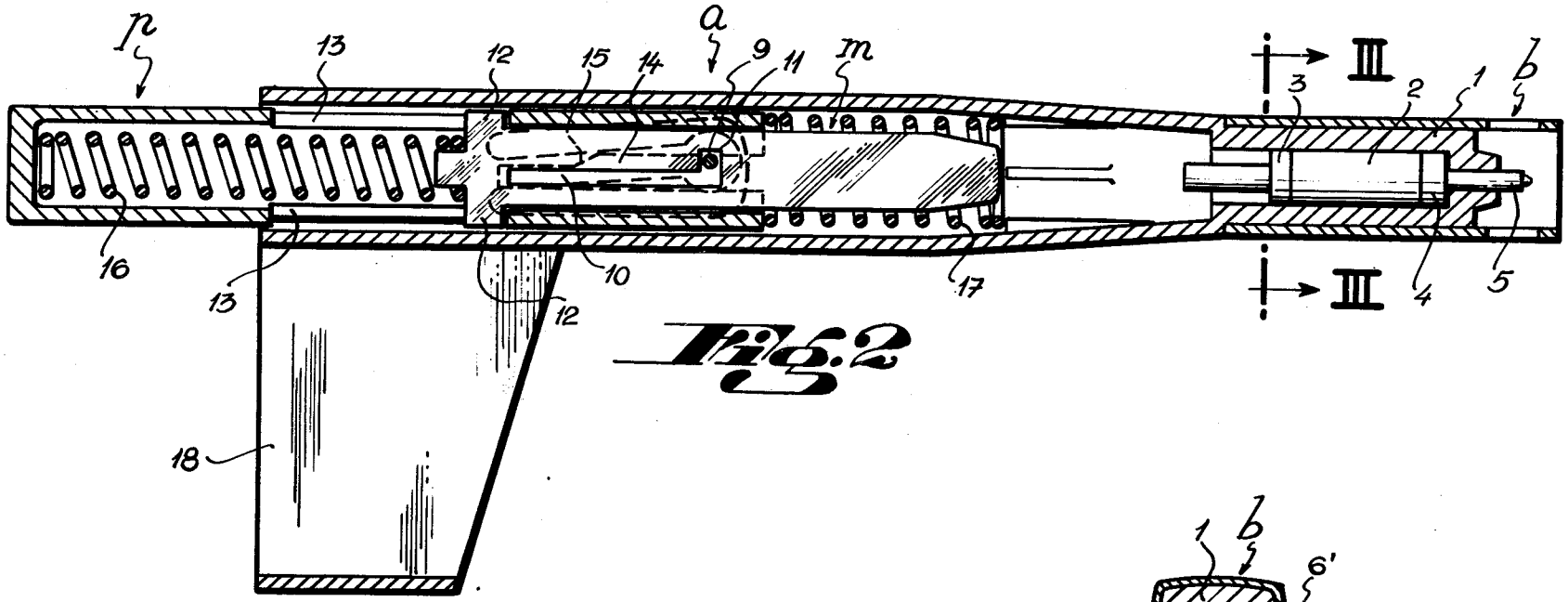
FIG. 2 is a side cross-sectional view of the assembled lighter of FIG. 1 in which the setting of the component elements of the assembly may be observed in a fixed position.

The operation of the lighter, as appears from the foregoing description and illustration, is very simple and efficient. In the initial fixed position of the assembly (FIG. 2) the pulsator p has its front portion housed in the body a with the return spring 17 and the load spring 16 extended. The hammer m is guided within the pulsator p with its projections 12 displaceable in the longitudinal grooves 13 of pulsator p. Hammer m is retained in the initial fixed position by the transversal rod 9 that joins the ends of the elastically deformable lugs 8 formed on the walls of body a. The rod 9 is housed in the bend 11 of the groove 10 of the hammer m.

Figures 3, 4:
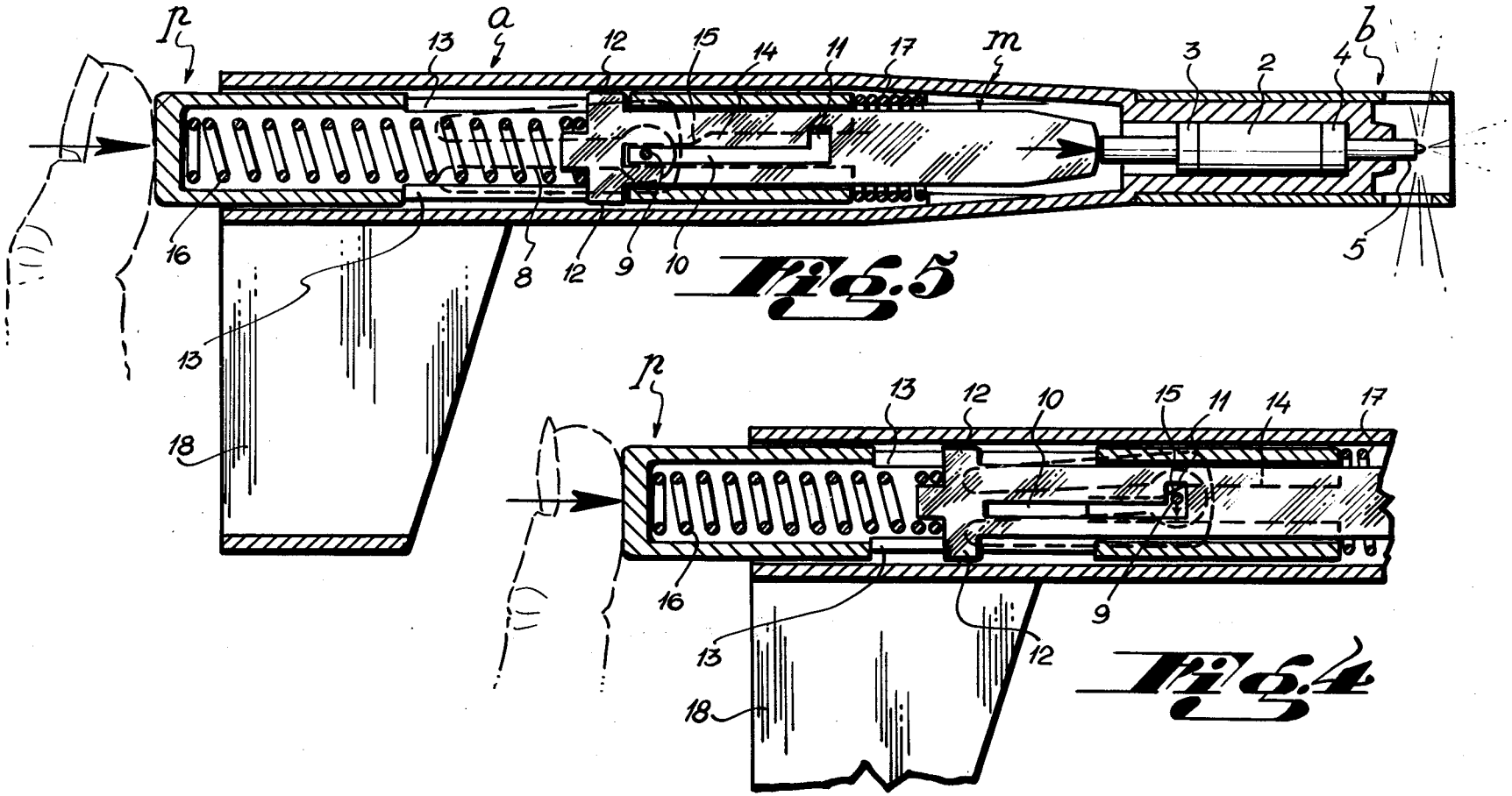
FIG. 4 is a partial view of the lighter similar to FIG. 2, but showing how pressing the operation pulsator compresses the hammer load spring and the sloped edges of the side notches of the pulsator lugs, which are formed on the wall of the body, in the direction marked with an arrow in order to release the impact hammer; and finally.

By pressing the pulsator p (FIG. 4), the spring 16 of the hammer m is compressed and hammer m continues to be retained by rod 9, as well as the return spring 17 of the pulsator. The projections 12 have changed their relative position in the grooves 13 due to the advance of the pulsator p while the hammer m remains locked. The slanted portions 15 of the upper edges of the longitudinal openings 14 of pulsator p contact the transversal rod 9 in their forward displacement. When they are jammed against rod 9 and in their advance run, they displace rod 9 from the retention housing in bend 11 of groove 10 of hammer m (as shown with an arrow in FIG. 4), elastically deforming the lugs 8 the ends of which are joined by said rod 9.

In this condition, the hammer m is released and, through the action of compressed spring 16, is sharply thrust against the impact butt 3 to excite the piezoelectric material 2 (FIG. 5). The poles of piezoelectric material 2 are connected to the electrode 5 projecting from the support butt 4, and the nozzle b by means of the foled lug 6 and impact butt 3 respectively. The potential difference originated between the poles of the piezoelectric material produces a spark between the electrode 5 and the nozzle b.

When the pressure on the pulsator p ceases, the compressed return spring 17 operates on pulsator p and pushes it in the opposite direction of its former displacement, that is to say, outward. In this displacement, the front end edge of the longitudinal grooves 13 by means of the projections 12 guided on the same, draw the hammer m backward, and the rod 9 runs on the upper edge of groove 9 guided by same maintaining the lugs 8 elastically deformed. When the terminal bend 11 of said groove 10 coincides with the position of said rod 9, the resilience of the material that forms the body a causes the lugs 8 to recover their normal position, raising the rod 9 and inserting same in the retention position of hammer m in bend 11 corresponding to the initial position the lighter being once more in condition to be operated.

What is claimed is:

1. A compact piezoelectric lighter comprising, in combination:

(a) a support body of resilient material, said body having a first end, a second end and grooves which define elastically deformable lugs;

(b) piezoelectric ignition means for creating a spark, said piezoelectric means housed in said first end;

(c) a pulsator member displaceably housed in said second end;

(d) an impact hammer displaceably housed in said pulsator;

(e) a load spring housed between said pulsator member and said impact hammer;

(f) a return spring housed between said hammer and said piezoelectric means; and (g) a rod positioned through said body, said pulsator and said hammer;

(h) means for retaining said impact hammer in an initial retention position while said pulsator member is displaced toward said piezoelectric means, said retaining means elastically deforming after a predetermined displacement to release said hammer from said initial retention position for impact against said piezoelectric means, said retaining means being defined by said rod, said body, said pulsator and said hammer.

2. The apparatus as set forth in claim 1 wherein said lighter further comprises, (a) longitudinal openings in a side of said pulsator member, said openings having an inclined portion; and (b) a guide groove formed in said impact hammer, said grooves having a bend toward one end, said rod being positioned in said bend when said hammer is in said initial fixed position;

(c) said pulsator, said hammer and said rod positioned so that said inclined portion positioned contacts said rod and moves said rod from said bend when said pulsator is advanced to said predetermined advance position.

3. The compact piezoelectric lighter of claim 1 wherein said support body is molded from a substantially electrically insulating material, an end cavity on said first end being adapted to house a support butt and an impact butt, said piezoelectric means being positioned between said support butt and said impact butt, said butts defining poles of said piezoelectric means, said first end of said support body forming an insulating capsule for said piezoelectric means and adapted to receive an electrically conductive outer nozzle having an open end cavity, a terminal projecting from said support butt into said cavity of said nozzle defining one electrode, said nozzle connected to said impact butt thereby forming the other electrode of the assembly.

4. A compact piezoelectric lighter as set forth in claim 1 wherein said impact hammer is formed of a stamped plate adapted to be conveniently guided in said body and pulsator member.

* * * * *